US005711682A

United States Patent [19]

Maejima

[11] Patent Number: 5,711,682

[45] Date of Patent: Jan. 27, 1998

[54] ELECTRICAL CONNECTOR REQUIRING LOW INSERTION FORCE

[75] Inventor: Toshiro Maejima, Shizuoka-ken, Japan

[73] Assignee: Yazaki Corporation, Tokyo, Japan

[21] Appl. No.: 230,153

[22] Filed: Apr. 19, 1994

[30] Foreign Application Priority Data

Apr. 19, 1993 [JP] Japan ..... 5-091305

[51] Int. Cl.[6] ..... H01R 13/00

[52] U.S. Cl. ..... 439/157; 439/160; 439/341

[58] Field of Search ..... 439/341, 372, 439/152–160

[56] References Cited

U.S. PATENT DOCUMENTS

| | | | |
|---|---|---|---|
| 4,586,766 | 5/1986 | Hofmeister | 339/45 M |
| 4,941,837 | 7/1990 | Nakamura | 439/341 |
| 5,238,418 | 8/1993 | Koiner | 439/157 |
| 5,326,279 | 7/1994 | Sumida | 439/157 |

FOREIGN PATENT DOCUMENTS 2-123681 2/1990 Japan .

*Primary Examiner*—J. J. Swann

*Attorney, Agent, or Firm*—Wigman, Cohen, Leitner & Myers, P.C.

[57] ABSTRACT

An electrical connector requiring low insertion force, simple structure, few constituents and low cost. The connector includes a first connector housing for retaining a first connector element, a second connector housing for retaining a second connector element to be engaged with the first connector element and an operating lever having at least one hook part arranged at an end thereof. The first connector housing has at least one holder for engaging with the hook part to thereby rotatably support the operating lever. The second connector housing includes a side wall provided with a pin protruding therefrom and the operating lever further includes a slit for slidably engaging with the pin.

4 Claims, 2 Drawing Sheets

ELECTRICAL CONNECTOR REQUIRING LOW INSERTION FORCE

BACKGROUND OF THE INVENTION

This invention relates to an electrical connector capable of engaging at least one connector element with the other connector element with low insertion force by operating a lever of the connector.

In such a connector, there is a connector disclosed in U.S. Pat. No. 4,586,766. The connector comprises a first connector element arranged on a side of an electrical cable and a second connector element arranged on a side of an electrical instrument. The first connector element is provided with a hook part at the tip end thereof. In operation for engagement therebetween, the hook part is hung on a holder provided at the tip end of the second connector element. Then, the first connector element is pivoted about the holder by operating a handle, whereby the first connector element is integrally engaged with the second connector element. Therefore, in such a connector, special contrivances must be performed against a cavity of the second element, in which the first connector element is accommodated, and a configuration of the first connector element itself to attain the pivotal movement thereof about the second connector element.

Japanese Patent Laid Open (Kokai) No.2-123681 discloses a connector to countermeasure such restrictions derived from the pivotal movement. In the connector, a connector element, which is arranged on a side of an electrical instrument, is equipped with an immovable member of box-shaped configuration. On the other hand, a connector housing, which is arranged on a side of an electrical cable, is provided with cam projections. In the arrangement, the immovable member accommodates a sliding member provided with slanted guide grooves formed in both side walls of the immovable member. The slanted guide grooves are adapted to receive the cam projections, respectively.

In operation, after positioning of the connector housing against the sliding member, the later is slid, so that the former can be moved vertically to the immovable member on a function of the slanted guide grooves, whereby the connector element can be engaged with the connector housing. However, the above-mentioned connector comprises many constituents because of its complex construction, so that it costs expensively. Furthermore, the operation for engaging the connector element with the housing is not always easy.

SUMMARY OF THE INVENTION

It is an object of the present invention to provide an electrical connector capable of engaging one connector element with the other connector element with low insertion force.

It is an additional object of the present invention to provide an electrical connector of simple structure, of few constituents and of low cost.

The objects of the invention described above can be accomplished by an electrical connector requiring low insertion force to connect a first connector element arranged on a side of an electrical instrument with a second connector element arranged on a side of an electrical cable, the electrical connector comprising:

a first connector housing for retaining the first connector element;

a second connector housing for retaining the second connector element to be engaged with the first connector element; and an operating lever having at least one hook part arranged at an end thereof;

wherein the first connector housing has at least one holder for engaging with the hook part to thereby rotatably support the operating lever, the holder being arranged at an end of the first connector housing;

the operating lever having an operating part arranged at the other end, the operating part being depressed by an operator;

the second connector housing including a side wall provided with a pin protruding therefrom; and the operating lever further comprising a slit arranged between the one end of the lever and the other end of the lever, the slit slidably engaging with the pin to urge the pin so as to move it to a direction where the first connector element engages with the second connector element by rotating the operating lever.

With the arrangement mentioned above, when the operating lever is rotated upon engaging the hook part with holder, the pin is urged and moved by the slit moving with the lever. The moving direction of the pin corresponds to an engaging direction in which the first connector element is engaged with the second connector element, whereby the second connector housing can be moved in the engaging direction. That is, according to the present invention, the rotating force of the operating lever is converted into an engaging force of the first connector element with the second connector element, so that the former can be engaged with the latter. In other words, due to the relationship of engagement between the slit and the pin, the movement of the lever can be converted into the movement for engagement of the first connector element with the second connector element, whereby the engagement can be carried out with low insertion force.

Further, according to the invention, since the operating lever is provided with the operating part which is arranged at the other end of the lever, the operational ability of the connector can be improved to obtain the large engaging force in spite of its simple construction.

The other features of the present invention will become more fully apparent from the following description and appended claims taken in conjunction with the accompanying drawings.

DESCRIPTION OF THE PREFERRED EMBODIMENT

Figure 1:
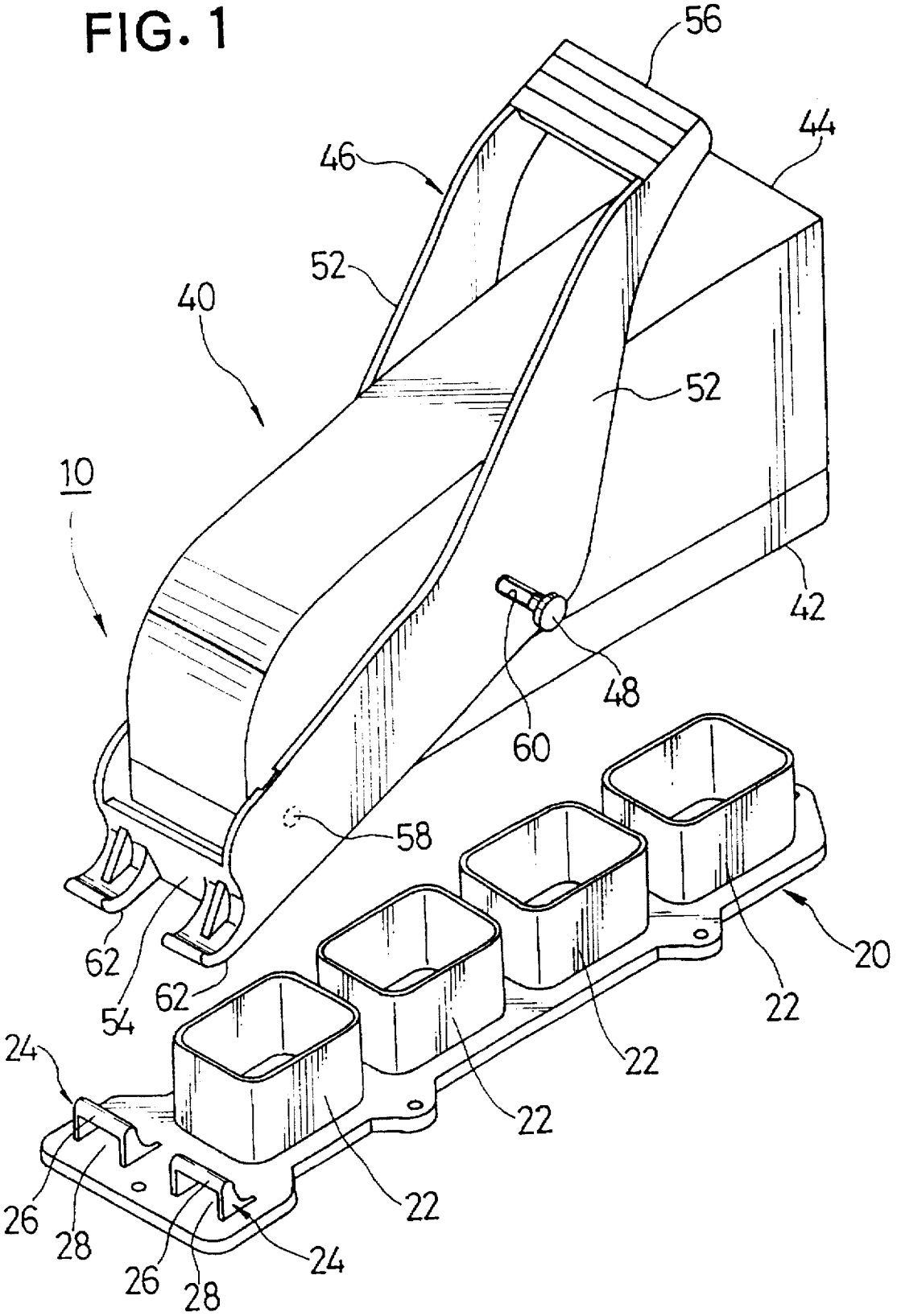
FIG. 1 is a perspective view showing a connector according to an embodiment of the present invention.

Referring initially to FIG. 1, reference numeral 10 denotes a connector system which comprises a first connector housing 20, which will be referred as a female connector housing hereinafter, for retaining small female connector elements (not shown), a second connector housing 40, which will be referred as a male connector housing hereinafter, for retaining small male connector elements (also not shown), and an operating lever 46. The female connector housing 20 is secured on a side of a not-shown electrical instrument to have a plurality of storage compartments 22 arranged on an elongated body thereof in a row. In an assembled state, the female connector elements are respectively accommodated in the storage compartments 22, whereby a female connector assembly is provided as a whole. A pair of holders 24 is arranged on an upper surface of the female connector housing 20. The holders 24 are positioned apart from each other at an end of the housing 20 in the longitudinal direction. As shown in FIG. 1, each of the holders 24 is constructed by a lateral bar 26 and a rectangular hole 28 defined thereunder.

The male connector housing 40, which is connected to electrical cables (not shown), comprises a rectangular frame body 42 and a cable cover 44 mounted thereon. Arranged inside the frame body 42 are the male small connector elements which constitute a male connector assembly. The male connector housing 40 has a pair of pins 48 each of which protrudes from a respective side wall thereof laterally. Each of the pins 48 is positioned at a center of the side wall of the housing 40 in the longitudinal direction. A temporary engaging part 58 is arranged at one end of the side wall to engage with the operating lever 46.

The operating lever 46, which is adapted to be a generally rectangular frame, comprises a pair of side plates 52 arranged outside of the side walls of the male connector housing 40, a front plate 54 connecting one end of the side plate 52 with one end of the other plate 52, and an operating plate 56 to be depressed, which connects the other end of the side plate 52 with the other end of the other plate 52. Further, a pair of hooks 62 are fixed on the front plate 54 of the lever 46. Each of the hooks 62 comprises a depressed plate adapted to be inserted into the holes 28. The operating lever 46 has slits 60 formed in both of the side plates to slidably engage with the pins 48 protruding therefrom, respectively. Each slit 60 is formed so as to obliquely and linearly extend from the lower edge of the side plate upwardly. Each of the slits 60 may have a slight curvature.

Figure 2:
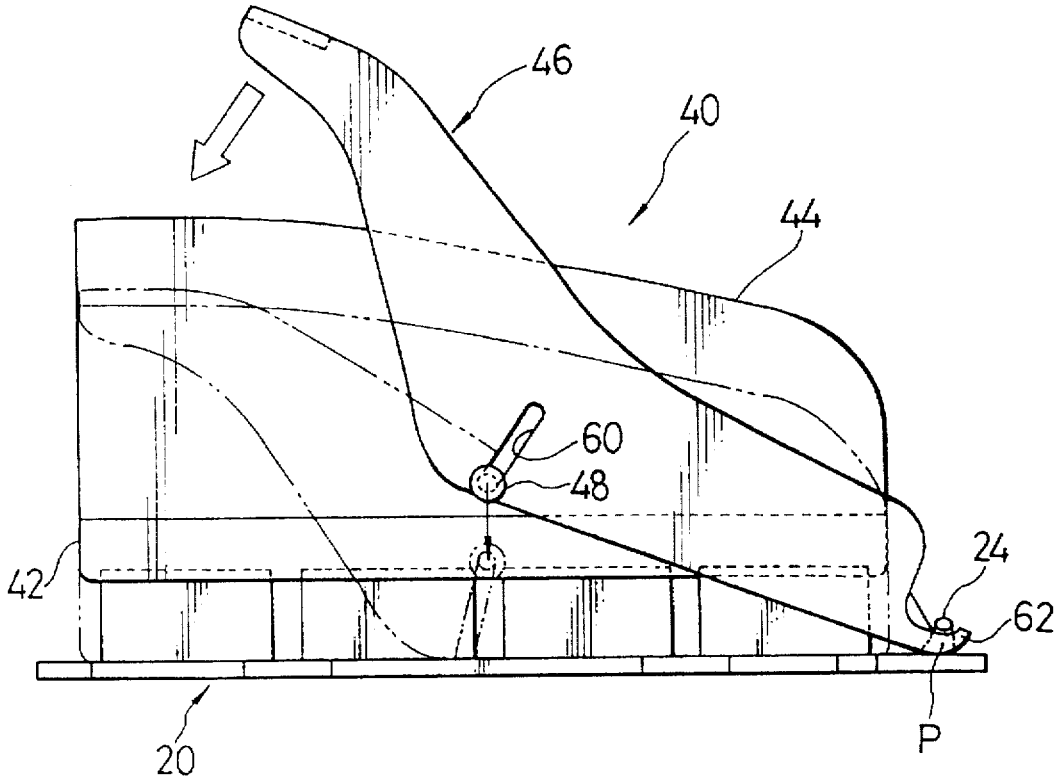
FIG. 2 is a side view showing the connector of FIG. 1 before operating for engagement.

FIG. 2 shows a relationship between the slits 60 and the pins 48 in greater detail.

The operating lever 46 is so constructed as to rotate about a pivot P on condition that the hooks 62 are engaged with the holders 24. Thus, the slits 60 of the operating lever 46 can rotate about the pivot P, also.

Figure 3:
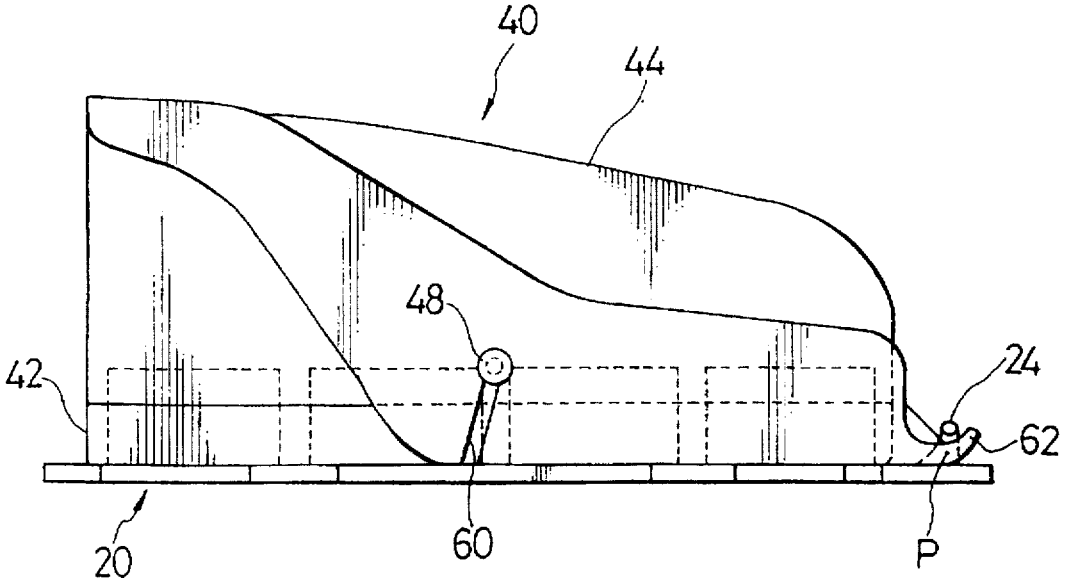
FIG. 3 is a side view showing the connector after operating for engagement.

In a state before the housing 40 is engaged with the housing 20, the pins 48 occupy a position shown with an actual line in FIG. 2, which will be referred to as the pre-engaging position hereinafter. Note that, it is also an object to provide a construction capable of lowering the pins 48 vertically from the pre-engaging position to a position shown with a dotted line in FIG. 2, which will be referred as the engaging position hereinafter. In order to attain the object, according to the invention, a distance between the pivot P and an inlet of the slit 60 is established to be substantially equal to a distance between the pivot P and the pin 48 in the pre-engaging position. In addition, a distance between the pivot P and the heart of the slit 60 is established to be substantially equal to a distance between the pivot P and the pin 48 in the engaging position. Under such establishments, the slit 60 is formed so as to connect the inlet with the heart linearly Operation is now described below, with reference to FIGS. 2 and 3.

In order to engage the male connector housing 40 with the female connector housing 20, on condition that the hooks 62 of the operating lever 46 are inserted into the holes 28 of the holders 24, respectively, the operating plate 56 is depressed in a direction shown by an arrow in FIG. 2. Being depressed, the operating lever 46 is rotated about the pivot P provided by the hooks 62 arranged at the tip end thereof and the holders 24 engaging therewith. Then, the slits 60 on both side plates 52 of the operating lever 46 are engaged with the pins 48 of the male connector housing 40, whereby the male connector housing 40 is moved downwardly by the rotation of the lever 46. At this time, since the positioning of the slits 60 is established as mentioned above, the male connector housing 40 can be moved vertically and downwardly, whereby the second connector elements carried by the housing 40 can be respectively engaged with the first connector elements retained in the female connector housing 20.

As mentioned above, according to the present invention, by rotating the operating lever, the second connector housing can be moved in the engaging direction of the first connector element with the second connector element, whereby the former can be engaged with the latter with low insertion force.

Furthermore, since the engagement between the first connector elements and the second connector elements can be attained only if the operating part is depressed to rotate the lever, the force for attaining such an operation can be reduced and the operation can be simplified.

Further, since the connector of the invention employs such a simple construction that the first connector housing is provided with the holder, the second housing is provided with the pin, and the lever is provided with the hook and the slit, a number of parts of the connector can be reduced to thereby decrease the costs for manufacturing it.

Finally, it will be understood by those skilled in the art that the foregoing description of the preferred embodiments of the disclosed structure, and that various changes and modifications may be made to the present invention without departing from the spirit and scope thereof.

What is claimed is:

1. A low insertion force electrical connector system requiring low insertion force to engage a first connector element arranged on a side of an electrical instrument with a second connector element arranged on a side of an electrical cable, said electrical connector system comprising:

a first connector housing for retaining said first connector element;

a second connector housing for retaining said second connector element to be engaged with said first connector element, said second connector housing including opposing sidewalls provided with a pair of pins, each protruding laterally from a respective one of said opposing sidewalls; and an operating lever of a shape forming a frame for accommodating said first connector housing therein, said frame comprising a pair of side plates, a front plate connecting front ends of said side plates with each other, and a rear plate connecting rear ends of said side plates with each other to provide an operating part to be operated by an operator, said front plate being provided with at least one hook part having a depressed plate, said operating lever further including a slit formed in each of said side plates and extending obliquely from lower edges of said side plates engageable with said pins;

wherein said first connector housing has at least one holder arranged at an end of said first connector housing to engage with said at least one hook part and to thereby rotatably support said operating lever, said at least one holder further comprising a lateral bar and a hole which is positioned under said lateral bar and into which said depressed plate of said at least one hook part is inserted; and wherein, when said operating lever is rotated about said at least one holder of said first connector housing, said pins are urged downwardly by slidable engagement with said slits, whereby said second connector housing is moved directly toward said first connector housing.

2. The electrical connector system of claim 1, wherein said front plate of said operating lever has two hook parts arranged apart from each other, and wherein said first connector housing has two holders to engage with said two hook parts, respectively.

3. The electrical connector system of claim 1, wherein said at least one hook part and said at least one holder cooperate to align longitudinal axes of the first and second connector housings, and the pins and the slits cooperate with said at least one hook part and said at least one holder to precisely position the first and second connector housings along respective longitudinal axes thereof.

4. The electrical connector system of claim 1, wherein said front plate has at least two hook parts separated one from the other, and said first connector housing has at least two holders mating therewith and separated one from the other, said at least two holders being positioned to mate with said at least two hook parts to precisely position the first and second connector housings along respective longitudinal axes thereof.

* * * * *